US009947301B2

(12) United States Patent
Kelsey

(10) Patent No.: US 9,947,301 B2
(45) Date of Patent: Apr. 17, 2018

(54) PIANO MUSICAL NOTATION

(71) Applicant: Piano By Numbers LLC, Oak Park, IL (US)

(72) Inventor: Nathan Kelsey, Oak Park, IL (US)

(73) Assignee: PIANO BY NUMBERS, LLC, Oak Park, IL (US)

( * ) Notice: Subject to any disclaimer, the term of this patent is extended or adjusted under 35 U.S.C. 154(b) by 0 days.

(21) Appl. No.: 15/001,234

(22) Filed: Jan. 19, 2016

(65) Prior Publication Data

US 2016/0210948 A1 Jul. 21, 2016

Related U.S. Application Data

(60) Provisional application No. 62/134,430, filed on Mar. 17, 2015, provisional application No. 62/104,402, filed on Jan. 16, 2015.

(51) Int. Cl.
*G10G 1/04* (2006.01)

(52) U.S. Cl.
CPC ..... *G10G 1/04* (2013.01)

(58) Field of Classification Search
CPC ..... G09B 15/00; G09B 15/02; G09B 15/026; G09B 15/003; G09B 5/02; G09B 11/00; G09B 11/02; G09B 11/04; G10H 2220/015; G10G 1/00; G10G 1/02
USPC ..... 84/470 R, 483.1, 483.2
See application file for complete search history.

(56) References Cited

U.S. PATENT DOCUMENTS

2004/0224295 A1* 11/2004 Harrison ..... G09B 15/001 434/307 R

* cited by examiner

*Primary Examiner* — Kimberly Lockett
(74) *Attorney, Agent, or Firm* — Richards Patent Law P.C.

(57) ABSTRACT

A musical notation for piano music includes a top line including right finger numbering denoting finger positions of fingers of the right hand on keys of a piano and a bottom line including left finger numbering denoting finger positions of fingers of the left hand on keys of the piano. Each of the right and left finger numbering includes the numbers 1, 2, 3, 4, and 5 that correspond to the thumb, the pointer finger, the middle finger, the right finger, and the pinky finger, respectively. Each of a right hand position change and a left hand position change is denoted by a symbol. A chord is denoted by stacked finger numbering.

22 Claims, 8 Drawing Sheets

Fig. 1A
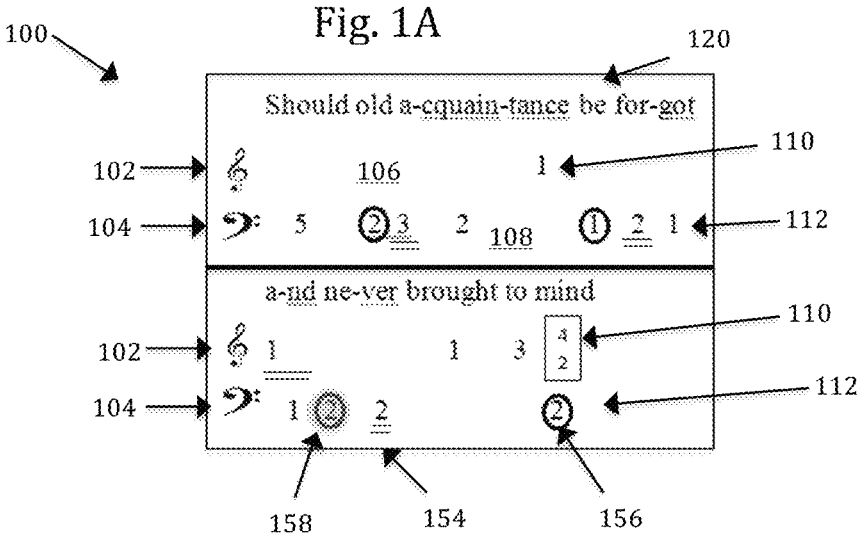
Fig. 1B
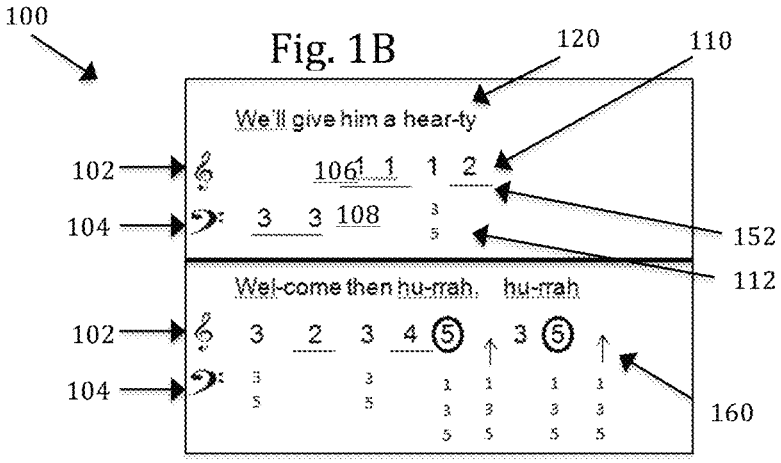
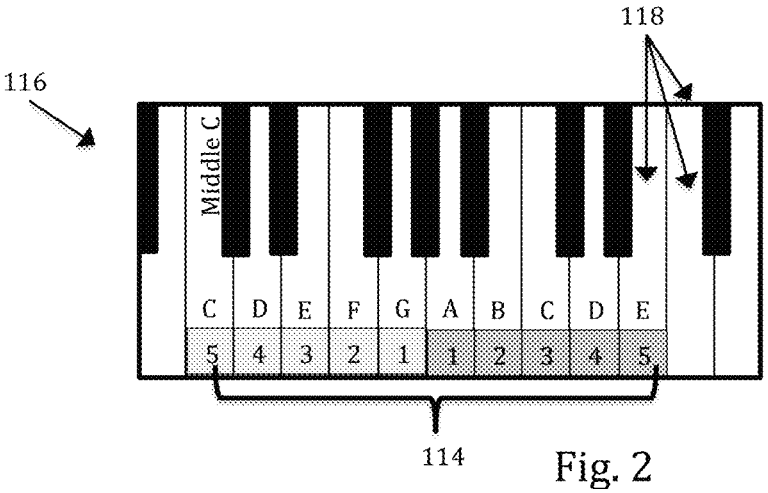
Fig. 2

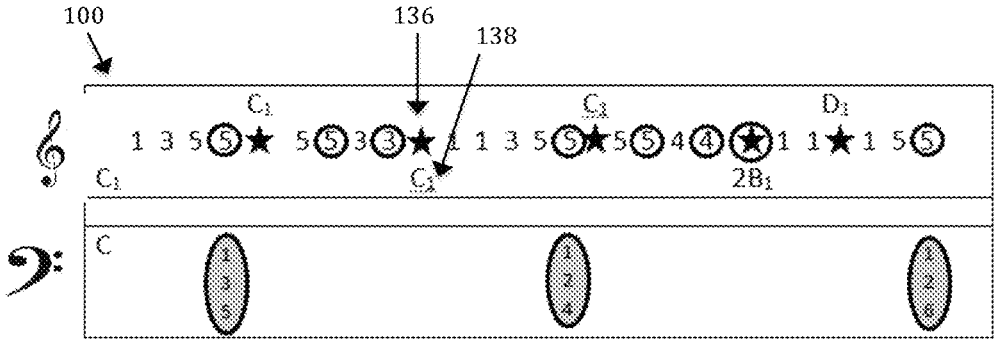
Fig. 4C
Fig. 5
Rhythm symbols
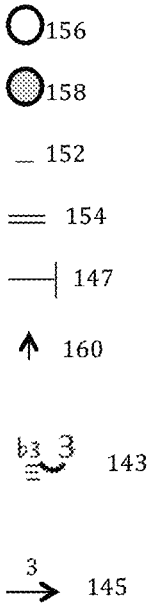
Fig. 6
Position Changes
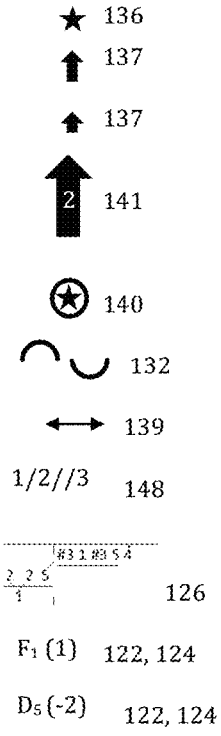

Auld Lang Syne-1

In the Hall of the Mountain King-3

Oh Susanna-2

PIANO MUSICAL NOTATION

CROSS-REFERENCE TO RELATED APPLICATIONS

This application incorporates by reference and claims the benefit of priority to U.S. Provisional Application No. 62/104,402 filed on Jan. 16, 2015, and U.S. Provisional Application No. 62/134,430 filed Mar. 17, 2015.

BACKGROUND OF THE INVENTION

The present subject matter relates generally to music notation for piano music. Specifically, the subject matter relates to music notation including finger numbering to simplify a student's understanding of hand positions for a musical piece.

Learning to play the piano is challenging, particularly during the first few years. Beginners particularly have trouble reading traditional piano music. Typically students learn from sheet music of classic songs, exercise songs created by publishing companies, or other materials that are not particularly student friendly.

In a traditional setting, beginner piano students learn to identify both notes and intervals on the treble and bass clefs and develop a basic understanding of the scales and chords, including key signatures and the differences between sharps and flats. Students learn to understand the pattern of the clefs in order to read the notes on the staves as well as rhythm symbols such as whole, half, quarter, eighth, sixteenth and triplet notation and song structure notation such as D.S. al Fine, D.C. al Fine, repeat signs, and coda notation. With respect to piano music specifically, students learn to recognize hand position changes such as stretching and crossovers. Sight reading, or even just competent reading, may take years of studying various types of songs to develop.

Accordingly, there is a need for piano musical notation that simplifies the student's understanding of the hand positioning as he learns to play the piano.

BRIEF SUMMARY OF THE INVENTION

To meet these needs and others, the present disclosure provides a musical notation for piano music that includes finger positioning for notes rather than merely indicating which note is to be played as is provided in standard sheet music. Traditional music notation includes a note head on the treble or bass clef to indicate the pitch and rhythm for each note. In contrast, the musical notation of the present application includes finger numberings of hand positions that correspond to pitches with additional markings to denote rhythmic changes. A student can easily see exactly which piano key is to be struck, allowing for quick comprehension of the hand and finger positions. As the student progresses, he more easily understands the relationship between the notes of the traditional music notation with the finger and hand positions.

The music notation includes stacked treble and bass clefs similar to those of standard music notation, but including finger numbering positions that correspond to the pitch of the key to be struck instead of note heads on a staff of horizontal lines and spaces. The finger numbering of the notation of the present disclosure corresponds to finger number positioning on the keys of a piano. The finger number positioning includes the numbers 1, 2, 3, 4, and 5 that denote placement of the thumb, the pointer finger, the middle finger, the ring finger, and the pinky finger of the respective hand on the keys of the keyboard.

The music notation includes a starting hand position for each of the right and left hands. In one embodiment, the starting hand positions are provided adjacent to the title at the beginning of the notation. The starting hand positions provide the initial note for the thumb of each hand.

Markings such as underlines and circles indicate rhythmic changes in the music notation. The purpose of the markings is to note relative changes in rhythm as compared to a standard rhythmic duration set forth by a finger numbering without any markings. For example, a finger position without any marking may indicate a quarter note, while a geometric shape such as a circle surrounding a finger position may indicate a half note. The musical notation may include an indicator such as star to denote a shift in the placement of the hand on the keys of the piano.

Symbols such as a star, an arrow, a connecting arrow, or an arc may denote a change in hand positions, including stretching or crossovers/unders.

In one embodiment, a musical notation for piano music includes a top line including right finger numbering denoting finger positions of fingers of the right hand on keys of a piano and a bottom line including left finger numbering denoting finger positions of fingers of the left hand on keys of the piano. Each of the right and left finger numbering includes the numbers 1, 2, 3, 4, and 5 that correspond to the thumb, the pointer finger, the middle finger, the right finger, and the pinky finger, respectively. A right hand position change is denoted by a symbol, and a chord is denoted by stacked finger numberings.

The positioning of the symbol relative to the right finger numbering may correspond to one of upward or downward movement of the right hand position on the piano keys. The symbol may comprise a star positioned above the right finger numbering that corresponds to upward movement of the right hand position on the piano keys, or a star positioned below the right finger numbering that correspond to downward movement of the right hand position on the piano keys. The symbol may also comprise an arrow within the top line, wherein the arrow pointing up corresponds to upward movement of the right hand position on the piano keys, and wherein the arrow pointing down corresponds to downward movement of the right hand position on the piano keys. Alternatively, the symbol may comprise a connection arrow between a first finger positioning and a second finger positioning different from the first finger positioning, wherein the connection arrow denotes that the right hand position change includes movement of the hand so that a position initially occupied by a first finger associated with the first finger position is then occupied by a second finger associated with the second finger positioning. Finally, the symbol includes an arc under one of the finger numberings.

In other embodiments, a left hand position change is denoted by a bar including a pitch and an associated finger numbering. A finger numbering with a marking may denote rhythmic changes. Specifically, the marking may denote a rhythmic duration different than a rhythmic duration of a finger numbering without a marking. The marking may comprise one of a single line, a double line, a geometric shape, and a shaded geometric shape. In one embodiment, the geometric shape denotes a half note.

The musical notation may also include an arrow crossing between a right hand numbering on the top line and a left hand numbering on the bottom line, wherein the arrow denotes a short rhythmic duration between the right and left hand numberings.

Further, the musical notation may also include a right starting position and a left starting position for the right hand and the left hand, respectively. In one embodiment, the musical notation may include a diagram of piano keys illustrating the right starting position and the left starting position. The right starting position and the left starting position on the diagram of piano keys may be color coded. The right starting position and the left starting position may denote a pitch and a finger numbering for each of the right thumb and one of the left thumb and the left pinky finger. In some embodiments, the piano keys include a plurality of octaves, and each of the right starting position and the left starting position may denote the octave of the pitch. For example, the octave of the pitch may be denoted by an integer, wherein the octave starting with middle C is 0, wherein each octave above the middle C is numbered in consecutive positive integers, and wherein each octave below the middle C is numbered in consecutive negative integers.

In further embodiments, the finger numbering may include a letter note having an associated finger numbering, wherein the letter note denotes a pitch and the finger numbering denotes which finger is used to strike one of the keys that corresponds to the pitch.

The top bar may include a home position row and a stretch position row, wherein the home position row includes right finger numbering denoting finger positions, and wherein the stretch position row includes right finger numbering corresponding the finger numbering of the home position row but on one or more pitches higher than the pitch of the finger numbering of the home position. Further, the musical notation may include one or more lines between the home position row and the stretch position row that corresponds to the number of pitches higher than the corresponding finger numbering in the home position row. The positioning of the stretch position row above the home position row may indicate that an upward stretch, and wherein positioning of the stretch position row below the home position row may indicate that a downward stretch.

The musical notation may include one or more slashes in one of the top row and the bottom row to denote stretching of a finger position.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIGS. 1A and 1B are musical notations of songs in accordance with the present invention.

FIG. 2 is an example diagram of piano keys indicating the right and left hand finger numbering in accordance with the present invention.

FIGS. 4A-4C are additional examples of musical notations in accordance with the present invention.

FIG. 5 is a table of markings indicating rhythmic changes in the musical notation of the present disclosure.

FIG. 6 is a table of markings indicating position changes in the musical notation of the present disclosure.

DETAILED DESCRIPTION OF THE INVENTION

Figure 3A:
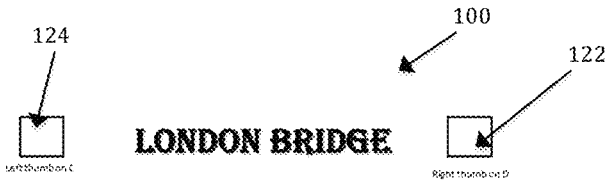
FIGS. 3A and 3B are examples of musical notation including right and left hand starting positions.

The present disclosure provides a notation for piano music that includes finger positioning for notes rather than merely indicating which note is to be played as is provided in standard sheet music. Traditional music notation includes a note head on the treble or bass clef to indicate the pitch and rhythm for each note. In contrast, the musical notation of the present application includes finger numberings of hand positions that correspond to pitches with additional markings to denote rhythmic changes. A student can easily see exactly which piano key is to be struck, allowing for quick comprehension of the hand and finger positions. As the student progresses, he more easily understands the relationship between the notes of the traditional music notation with the finger and hand positions.

FIGS. 1A and 1B illustrate example music notations 100 that include a top bar or treble clef 102 and a bottom bar or bass clef 104 stacked atop one another similar to a standard grand staff. Each of the treble and bass clefs 102, 104 include a row 106, 108 of finger number positions 110, 112 instead of the note heads on horizontal lines and spaces of the standard grand staff.

An example diagram of the placement of fingers 114 on a piano 116 is provided in FIG. 2. The finger numbering 110, 112 provided in the music notation 100 corresponds to the placement of fingers 114 on the keys 118 of a piano 116. The numbers 1, 2, 3, 4, and 5 correspond to the placement of the thumb, the pointer finger, the middle finger, the ring finger, and the pinky finger, respectively, on the piano keys 118. In the illustrated example, the right and left thumbs are positioned on the A and G notes, respectively. In some embodiments, the diagram of the piano keys 118 illustrating the placement of fingers 114 may be color coded. The right and left hand finger positions may be shown in different colors such as green and yellow, respectively.

Referring back to FIG. 1, the treble clef 102 includes right finger number positions 110 that denote the finger positions of fingers of the right hand. The bass clef 104 includes left finger number positions 112 that denote the finger positions of fingers of the left hand. Each finger number position 110, 112 of the right and left finger numbering is placed along the respective treble and base clef 102, 104 at a point in the song that corresponds to the pitch in the melody. For example, the first finger number position 112 on the bass clef 104 in the song "Auld Song Laud" as shown in FIG. 1 is 5, which corresponds to the note C as shown in FIG. 2.

The examples shown in FIGS. 1A and 1B include lyrics 120 provided above the treble and bass clefs 102, 104. The words may be hyphenated as necessary to show syllable and note changes as well as any single syllable words or vocal sounds that has its own distinct melody. In other embodiments, the lyrics 120 may be positioned between the stacked treble and bass clefs 102, 104.

Figure 3B:
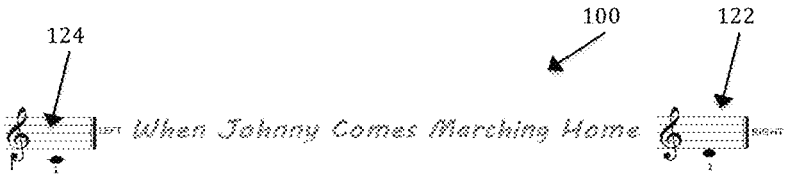

Referring to FIGS. 3A and 3B, the musical notation 100 includes a right starting position 122 and a left starting position 124 for the right thumb and the left thumb, respectively. In one embodiment, the starting positions may include the phrase "Left/Right Thumb on [Pitch]" as shown in FIG. 3A, or include a portion of a staff with a note head indicating the left or right starting positions as shown in FIG. 3B.

In some cases, the melody of the song will include outer notes 126 beyond the reach of the ten notes of the finger numbering 114. When the melody only occasionally includes outer notes 126, the fingers may stretch or crossover or under to reach the outer notes 126. These outer notes 126 may be denoted by finger numbering other than 1-5, such as 6, 0, or +1. When the melody consistently includes outer notes 126, the hand positioning may change so that the fingers do not stretch or crossover.

Figure 4A:
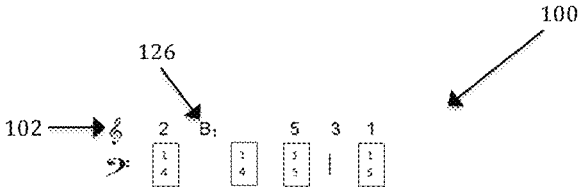

In the embodiment illustrated in FIG. 4A, the outer note 126 is denoted in the treble clef 102 by the corresponding letter note with an associated finger numbering, indicating that the finger numbering in the subscript should strike the piano key 118 that corresponds to the letter note. In some embodiments, the associated finger numbering may be provided in a subscript or superscript position relative to the letter note.

Figure 4B:
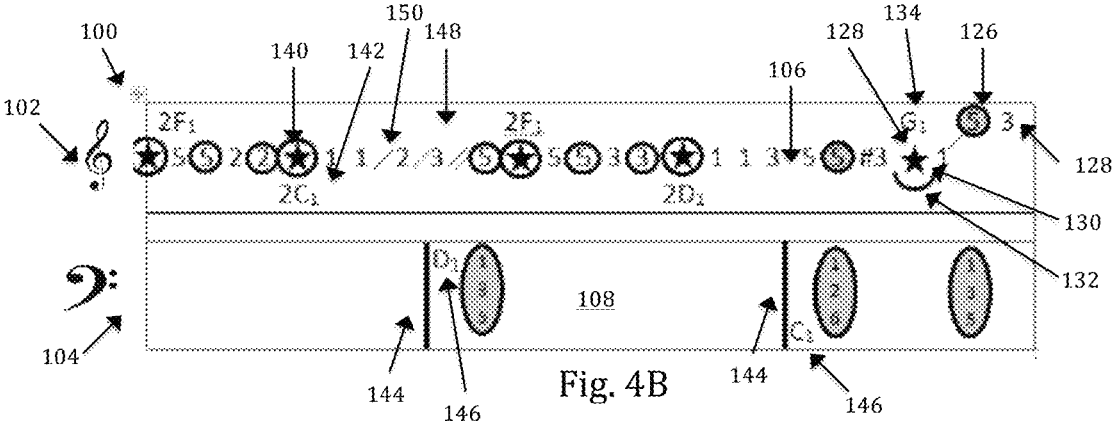
Figure 7:
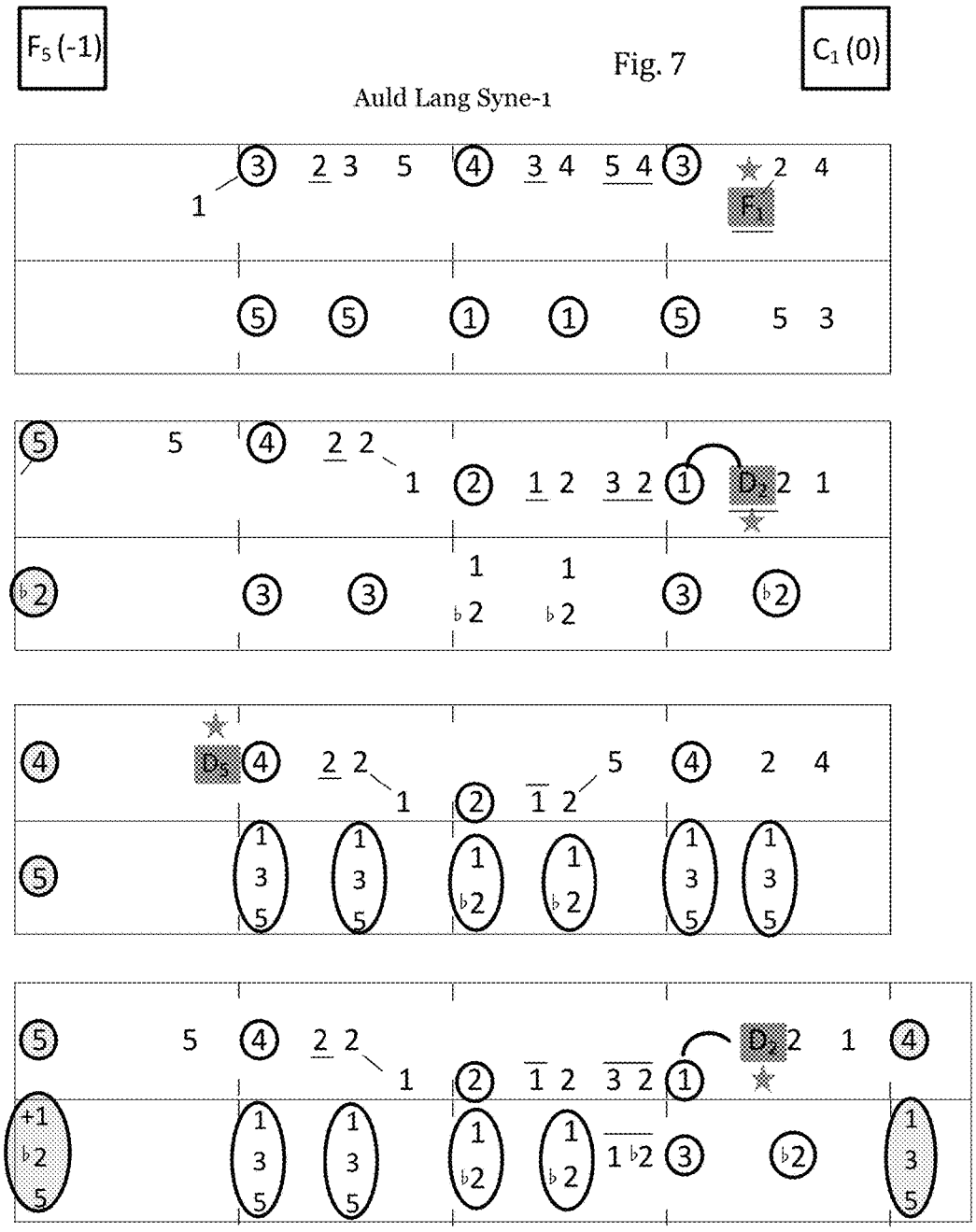
FIGS. 7-9, 10A, and 10B are example musical notations of songs in accordance with the present application.
Figure 8:
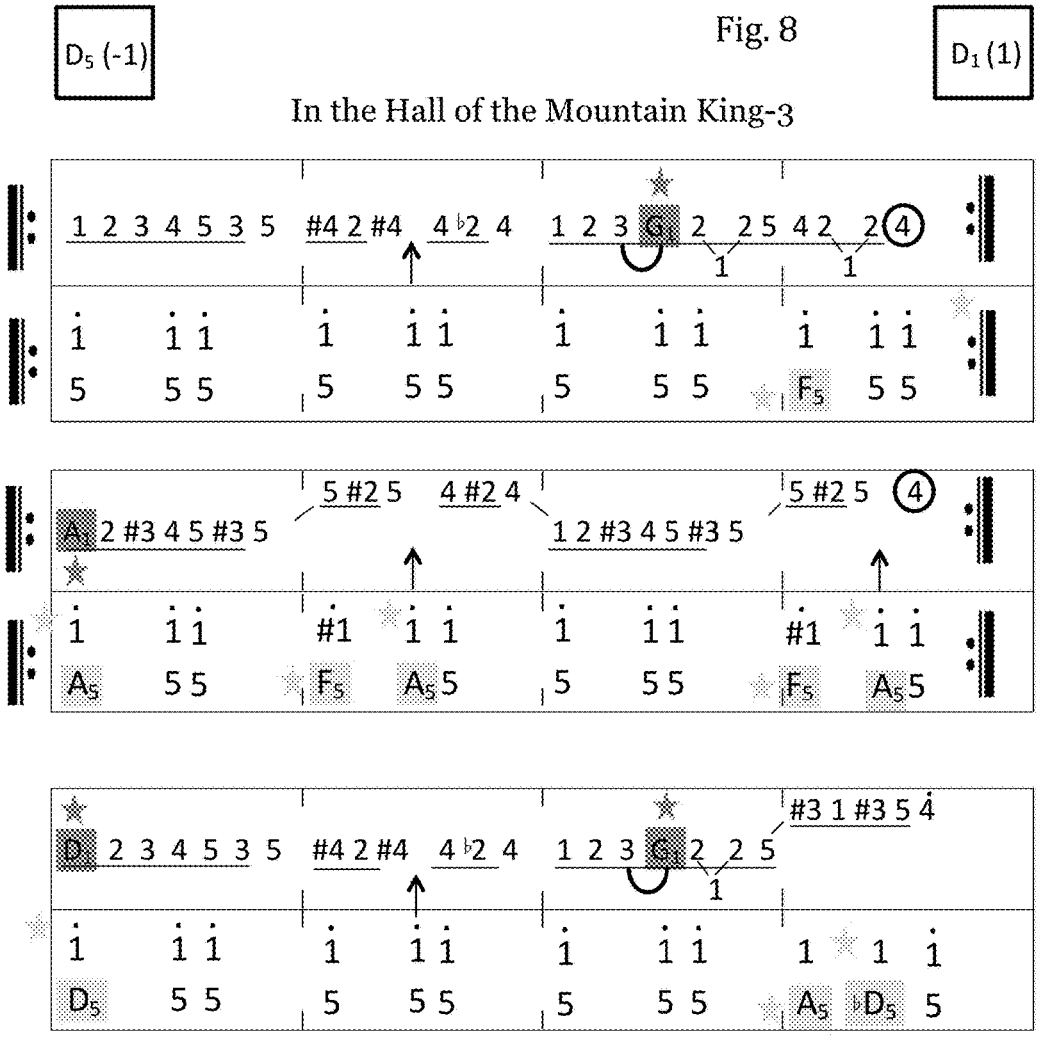
Figure 9:
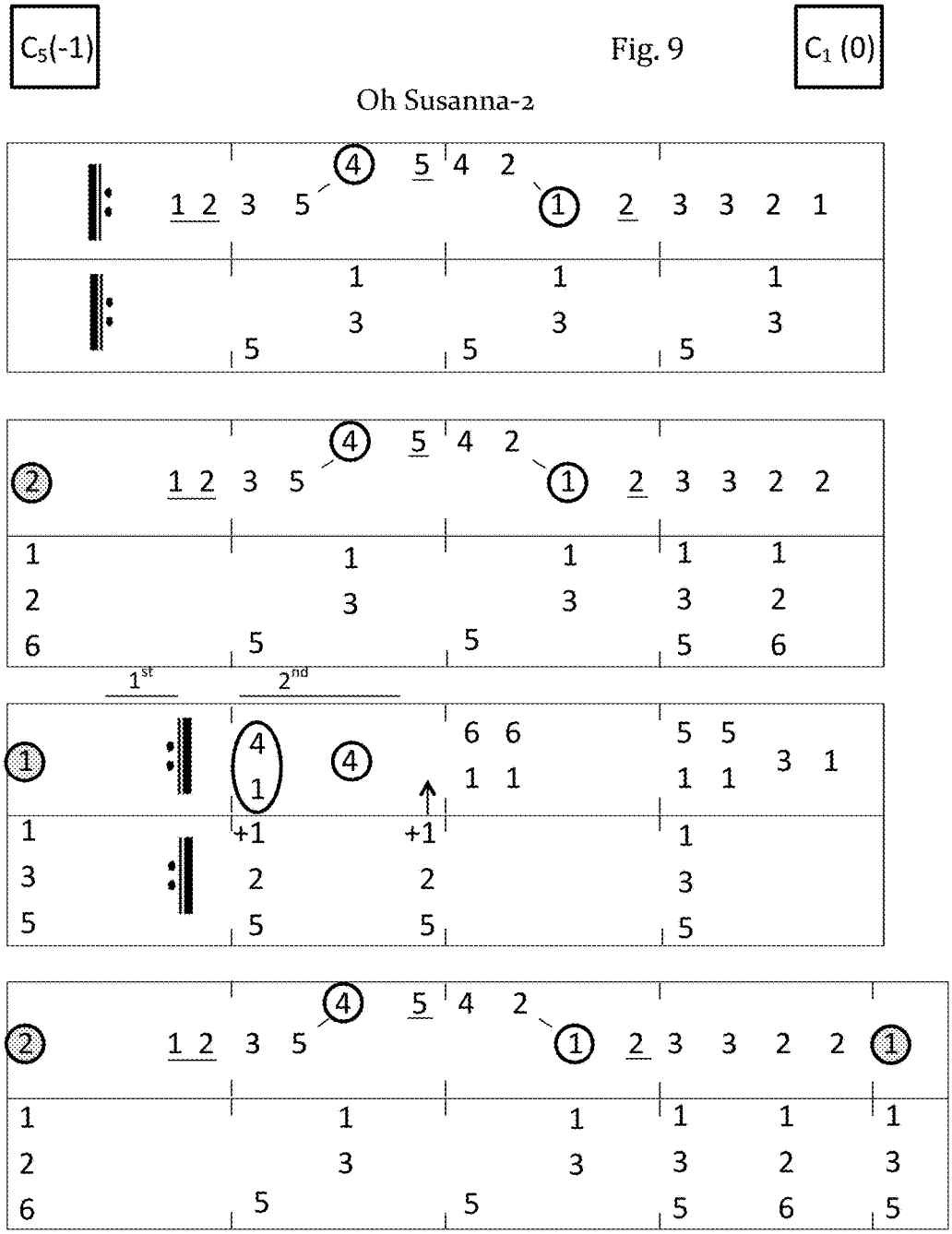
Figure 10A:
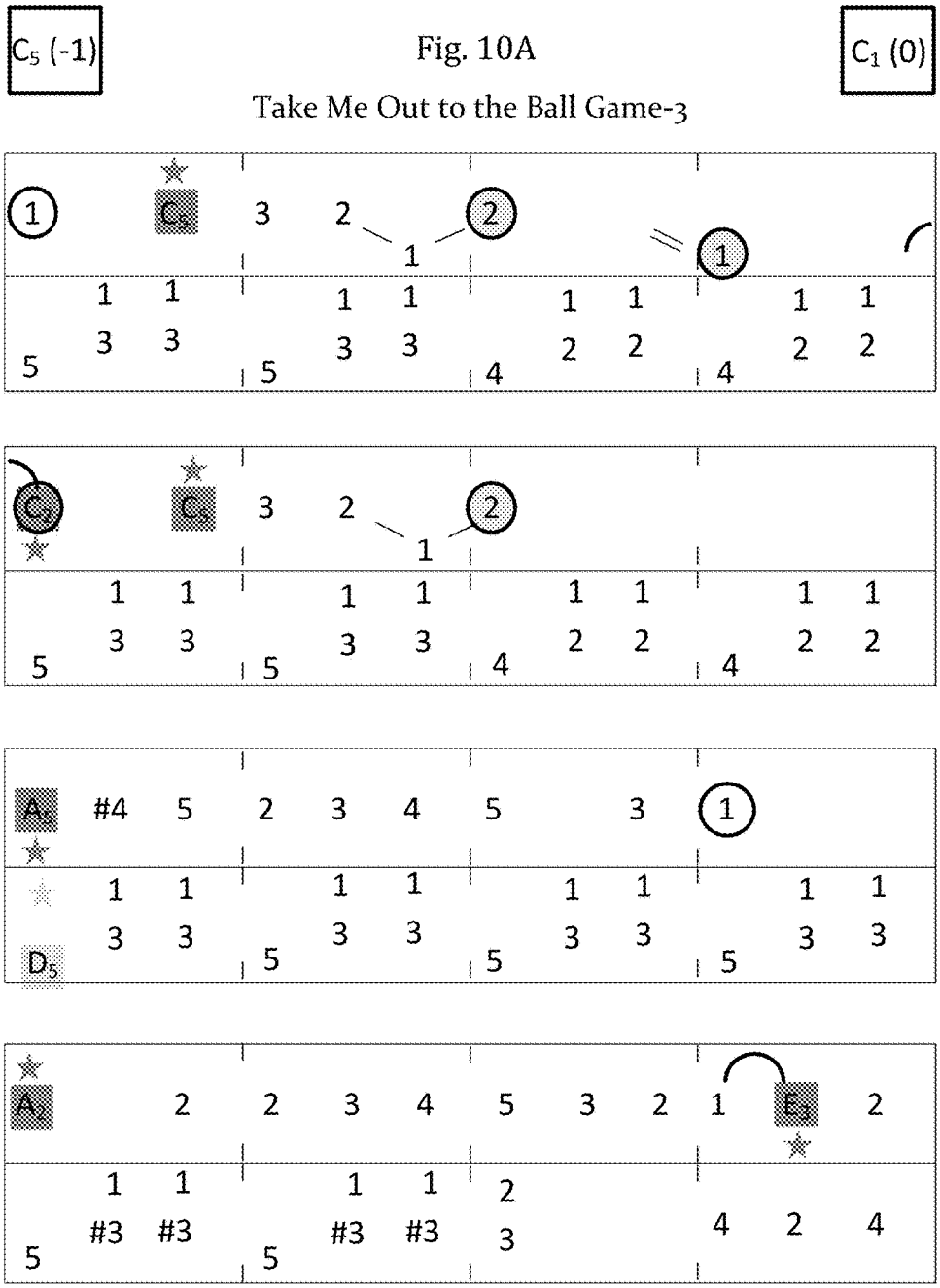
Figure 10B:
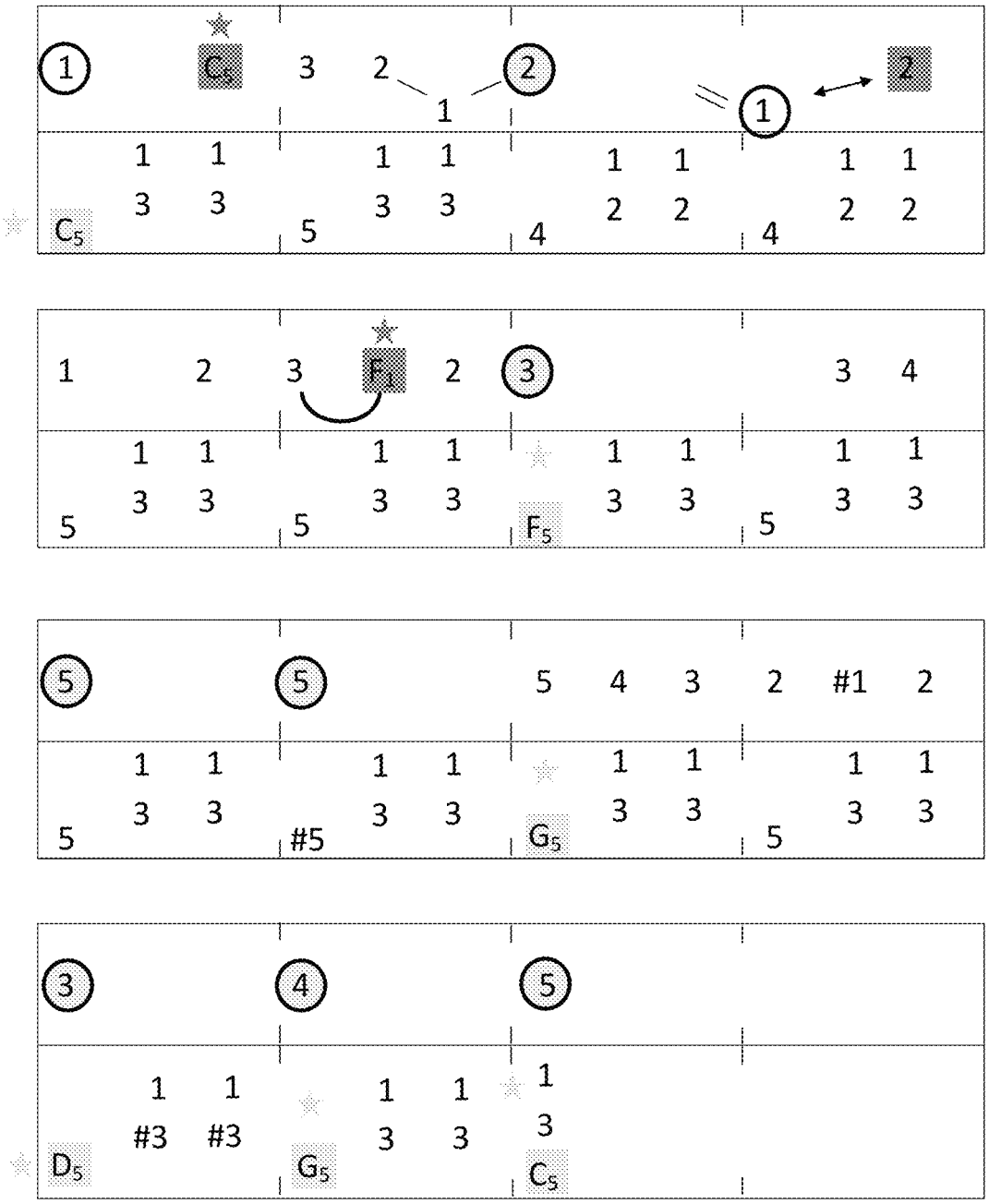

In the embodiment illustrated in FIG. 4B, the musical notation indicates that the fingers of the right hand will stretch to reach the outer notes 126. The row 106 of finger numbering treble clef 102 may include right finger number positions 110 referred to as the home position row 106. The treble clef 102 may include a stretch position row 128 that includes right finger numbering 126 corresponding the finger numbering of the home position row but on one or more pitches higher than the pitch of the finger numbering of the home position row 106. In the example provided, the thumb is positioned on G and the pinky is positioned on D, but the pinky stretches to play the outer note E. The middle finger is positioned on B but stretches to play the outer note C.

The musical notation 100 of FIG. 4B also includes a star 130 with an arc 132 to denote the crossing over or under of a finger position. The positioning of the arc 132 above or below the star 130 indicates a crossover or under, respectively. The letter note 134 to be reached is provided above the star 130, with an associated finger numbering indicating the finger to be used.

With respect to the bass clef 104, the stretch of a finger to an adjacent finger position may be denoted by a finger number other than 1-5. For example, as shown in FIG. 4B, the finger numbering 6 may be used to indicate that the pinky finger should strike the key to the left of the pinky finger position.

The music notation 100 may include a symbol such as a star 136, an arrow 137, or a connecting arrow 139 to denote the change in the right hand position as shown in FIG. 6. The star 136 is provided in the row of finger numbering 106, 108 of the treble or bass clef 102, 104 with a letter note 138 including an associated finger numbering placed above or below the star 136. Placement of the letter note 138 above the star 136 indicates that the hand moves up to the new hand position, while placement of the letter note 138 below the star 136 indicates that the hand moves down to the new hand position. In other embodiments, the letter note 138 is positioned in the row of finger number 106, 108 and the star 136 is positioned above or below the letter note 138 to indicate movement of the hand position upwards or downwards. Movement of the hand position an octave up or down may be indicated by an encircled star 140 with the letter note 142 preceded by a number as shown in FIG. 4B. The number preceding the letter note 142 indicates how many octaves the hand position should skip up or down. Alternatively, the movement of the hand position one or more octaves up or down may be denoted by an arrow 141 pointing up or down, respectively, with the number of octaves to be skipped provided within in the arrow 141.

Also shown in FIG. 4B, a bar 144 may be used to indicate a change in the left hand position. A letter note 146 with a subscript finger numbering indicates the piano key 118 on which the finger should be positioned.

A melody may include an arpeggio 148, which includes a series of notes played in rapid succession. Rather than starring each finger numbering of the arpeggio, a series of slashes 150 between adjacent finger numberings 110 indicates that certain notes are to be skipped. A single slash 150 indicates that the finger numbering 110 following the slash 148 should strike the piano key 118 a note above the key 118 that the finger numbering would otherwise strike. Two slashes 150 indicate that the finger numbering 110 following the slashes should strike the piano key 118 two notes above the key 118 that the finger numbering would otherwise strike. The embodiment of FIG. 4B includes the arpeggio 1/2/3//5 in the C position, which corresponds to the notes C, E, G, and C played with the thumb, the pointer finger, the middle finger, and the pinky finger, respectively.

As the student becomes more advanced, he transitions out of the simple numbering system described above into a more advanced numbering system. The more advanced numbering system includes finger numberings other than 1-5 to denote outer notes 126. For example, the bass clef 104 may include patterns such as 1, 8, 5, and 8 to provide a bluegrass feel, or a pattern of 1, 3, 5, and 6 to provide a blues feel.

As shown again in FIGS. 1A and 1B, the musical notation includes markings to denote rhythmic changes. In a general sense, the markings are used to indicate proportions between notes so that students can develop a sense of the pattern of the rhythm. A single line 152 and a double line 154 above and/or under a finger numbering 110, 112 may denote an eighth note and a sixteenth note, respectively. An empty circle 156 and a shaded circle 158 around a finger numbering 110, 112 may denote a half note and a whole note, respectively. A horizontal arrow 145 with a number provided above as shown in FIG. 5 indicates the number of counts to hold a note. A horizontal line leading to a vertical line 147 positioned above a note indicates that a note is to be held. The markings may include a rest symbol such as a quarter rest symbol or a blank space. As shown in FIGS. 1B and 5, an arrow 160 crossing between the right and left hand numbering of the treble and bass clefs denotes a short rhythmic duration between the right and left hand numberings. Grace notes 143 and quick slides may be indicated by smaller font sizes for the note that is to be graced, with three lines underneath and a loop connecting the two notes together. Other markings may be used to indicate other rhythmic changes as desired.

Each of the musical notations of FIGS. 1A and 1B include chords notated by two or more finger numbers stacked on top of each other in a slightly smaller font than the rest of the finger numbering. The markings that denote rhythmic changes may also be used with the chord notation as well. Sharp and flat notes may be notated by including the sharp or flat symbol next to the finger numbering. Structural notation such as repeats, D.S/D.C. al fines, ritardandos, diminuendos, piano, and forte symbols are used when necessary or desired.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A musical notation for piano music comprising:

a top line including right finger numbering denoting finger positions of fingers of the right hand on keys of a piano; and a bottom line including left finger numbering denoting finger positions of fingers of the left hand on keys of the piano;

wherein each of the right and left finger numbering includes the numbers 1, 2, 3, 4, and 5 that correspond to the thumb, the pointer finger, the middle finger, the right finger, and the pinky finger, respectively;

wherein a right hand position change is denoted by a symbol; and wherein a chord is denoted by stacked finger numberings; and wherein the musical notation further includes a right starting position and a left starting position for the right hand and the left hand, respectively.

2. The method of claim 1, wherein a positioning of the symbol relative to the right finger numbering corresponds to one of upward or downward movement of the right hand position on the piano keys.

3. The method of claim 1, wherein the symbol comprises a star, wherein the star positioned above the right finger numbering corresponds to upward movement of the right hand position on the piano keys, and wherein the star positioned below the right finger numbering corresponds to downward movement of the right hand position on the piano keys.

4. The method of claim 1, wherein the symbol comprises an arrow within the top line, wherein the arrow pointing up corresponds to upward movement of the right hand position on the piano keys, and wherein the arrow pointing down corresponds to downward movement of the right hand position on the piano keys.

5. The method of claim 1, wherein the symbol comprises a connection arrow between a first finger positioning and a second finger positioning different from the first finger positioning, wherein the connection arrow denotes that the right hand position change includes movement of the hand so that a position initially occupied by a first finger associated with the first finger position is then occupied by a second finger associated with the second finger positioning.

6. The method of claim 1, wherein the symbol includes an arc under one of the finger numberings.

7. The method of claim 1, wherein a left hand position change is denoted by a bar including a pitch and an associated finger numbering.

8. The method of claim 1, wherein the musical notation includes a finger numbering with a marking to denote rhythmic changes.

9. The method of claim 8, wherein the marking denotes a rhythmic duration different than a rhythmic duration of a finger numbering without a marking.

10. The method of claim 9, wherein the marking comprises one of a single line, a double line, a geometric shape, and a shaded geometric shape.

11. The method of claim 10, wherein the geometric shape denotes a half note.

12. The method of claim 1, wherein the musical notation includes an arrow crossing between a right hand numbering on the top line and a left hand numbering on the bottom line, wherein the arrow denotes a short rhythmic duration between the right and left hand numberings.

13. The method of claim 1, wherein the musical notation includes a diagram of piano keys illustrating the right starting position and the left starting position.

14. The method of claim 13, wherein the right starting position and the left starting position on the diagram of piano keys is color coded.

15. The method of claim 1, wherein the right starting position and the left starting position denote a pitch and a finger numbering for each of the right thumb and one of the left thumb and the left pinky finger.

16. The method of claim 15, wherein the piano keys include a plurality of octaves, and wherein each of the right starting position and the left starting position denote the octave of the pitch.

17. The method of claim 16, wherein the octave of the pitch is denoted by an integer, wherein the octave starting with middle C is 0, wherein each octave above the middle C is numbered in consecutive positive integers, and wherein each octave below the middle C is numbered in consecutive negative integers.

18. The method of claim 1, wherein the finger numbering further includes a letter note having an associated finger numbering, wherein the letter note denotes a pitch and the finger numbering denotes which finger is used to strike one of the keys that corresponds to the pitch.

19. The method of claim 1, wherein the top bar includes a home position row and a stretch position row, wherein the home position row includes right finger numbering denoting finger positions, and wherein the stretch position row includes right finger numbering corresponding the finger numbering of the home position row but on one or more pitches higher than the pitch of the finger numbering of the home position.

20. The method of claim 19, wherein the musical notation includes one or more lines between the home position row and the stretch position row that corresponds to the number of pitches higher than the corresponding finger numbering in the home position row.

21. The method of claim 20, wherein the positioning of the stretch position row above the home position row indicates that an upward stretch, and wherein positioning of the stretch position row below the home position row indicates that a downward stretch.

22. The method of claim 21, wherein the musical notation includes one or more slashes in one of the top row and the bottom row to denote stretching of a finger position.

* * * * *